United States Patent [19]

Paulish

[11] Patent Number: 4,795,156

[45] Date of Patent: Jan. 3, 1989

[54] SQUARE BINGO DOBBER APPARATUS

[76] Inventor: Carol Paulish, 25-27 Diane Pl., Port Jervis, N.Y. 12771

[21] Appl. No.: 94,849

[22] Filed: Sep. 10, 1987

[51] Int. Cl.[4] ..... B43K 27/00

[52] U.S. Cl. ..... 273/148 R; 401/35

[58] Field of Search ..... 273/148 R; 401/17, 23, 401/34, 35, 198

[56] References Cited

U.S. PATENT DOCUMENTS

| | | | |
|---|---|---|---|
| 1,300,379 | 4/1919 | Greenfield | 401/35 |
| 3,192,933 | 7/1965 | Prince | 401/35 |
| 3,887,287 | 6/1975 | Rosh | 401/35 |
| 4,580,918 | 4/1986 | Baker et al. | 401/35 X |

*Primary Examiner*—Anton O. Oechsle
*Attorney, Agent, or Firm*—Leon Gilden

[57] ABSTRACT

A square bingo dobber is set forth to fully indicate, framed by coloration, a bingo square. The dobber of the instant invention utilizes an internal square porous applicator to impart a transparent color, such as yellow, to a central portion of a bingo square to be marked. A perimeter square ring applying an opaquecoloration frames the central square pad to highlight the central coloration and furthermore demarcates the particular square from surrounding ones. A central reservoir provides coloring fluid to the central square dobber portion and a surrounding reservoir thereabout provides fluid to the aforenoted ring-like dobber portion.

1 Claim, 1 Drawing Sheet

SQUARE BINGO DOBBER APPARATUS

BACKGROUND OF THE INVENTION

1. Field of the Invention

The present invention relates to bingo indicating devices, and more particularly pertains to a new and improved bingo indicating device which provides a central pad imparting coloration to a bingo square and a surrounding ring-like pad thereabout to highlight the central coloration and further demarcate said central coloration from surrounding bingo squares.

2. Description of the Prior Art

The use of applicator apparatus, such as dobbers, is well known in the prior art. It may be appreciated that the prior devices have been limited to unique preselected uses and as such their application for the appropriate marking of bingo squares has been limited. In this connection, there have been several attempts to provide indicating marking devices which may be easily utilized and impart desired indication by application of a marking liquid to a surface. For example, U.S. Pat. No. 4,498,796 to Gordon et al, sets forth the use of an applicator surgical scrub apparatus. The Gordon device is of interest for its many applicator surfaces but in essence, a single liquid is utilized to impart desired application to the sponge-like applicator and accordingly lacks of application to a bingo marking situation is resultant.

U.S. Pat. No. 4,225,254 to Holberg et al, sets forth another surgical scrub device with indicating indicia to a reservoir and typical of such priority devices provides a single surface applicator for dispensing and transfer selected liquids to a scrub surface.

U.S. Pat. No. 946,149 to Newman indicates a marking device which is essentially an applicator tip utilizing a single reservoir supplying a desired fluid through its tip to a desired surface. In the same vein, U.S. Pat. No. 776,719 to Beck and U.S. Pat. No. 4,05,086 to Berghahn set forth additional single applicator tips to transmit desired fluid to applicator surfaces differing essentially in the channel transport means to supply fluid to such tips.

U.S. Pat. No. 3,807,881 to Seidler is another in a series of single surface applicator tips formed with an interior and exterior applicator surface to provide a porous pad behind the applicator tip. While a variance and a somewhat improvement for its intended purpose of cosmetic application, the Seidler patent is of limited and certainly of no advantageous use for the marking of a bingo-type surface.

U.S. Pat. No. 2,873,464 to Rozenthal sets forth an indicating or stenciling device for applying desired liquid onto a surface. The particular type of applicator surface and hair-like applying means utilized by Rozenthal has been set forth as being advantageous in a stenciling environment, however, the device provides no further benefit and certainly does not overcome the shortcomings of other prior art devices.

U.S. Pat. No. 2,453,201 to Cushman is a further example of an applicator tip of general interest illustrating varying graphical heads that may be utilized with the single reservoir supply and while of interest in design and use, the apparatus is essentially a pen-type device for applying various configurations onto paper.

As such, it may be appreciated that there is continuing need for a new and improved bingo dobber apparatus which addresses both the problem of appropriate marking a bingo square and yet highlighting the same square while avoiding the problem of darkening the central portion as to make reading of the so-called numbers difficult or if not impossible.

SUMMARY OF THE INVENTION

In view of the foregoing disadvantages inherent in the known types of bingo dobber now present in the prior art, the present invention provides an square bingo dobber formed with a central fluid reservoir providing liquid contained therein to a central square transmission pad surrounded by a perimeter reservoir in encircling relationship to said central reservoir to provide a second fluid to a perimeter felt-like transmission pad in surrounding relationship to said central square pad. As such, the general purpose of the present invention, which will be described subsequently in greater detail, is to provide a new and improved bingo dobber which has all the advantages of the prior art dobber and none of the disadvantages.

To attain this, the present invention comprises a bingo dobber formed with a central fluid reservoir in communicating relationship to a square transmission pad or applicator to impart fluid from said central reservoir to a desired surface. A second reservoir in surrounding relationship to said central reservoir is positioned in communication wi&h a second applicator in surrounding relationship to said first applicator pad element.

In this manner, a conventionally square bingo card may be filled out wherein the surrounding pad will impart a framing effect to said number called wherein said central reservoir will be of a less opaque liquid to highlight said number whereby the number so called in any conventional game of bingo will be clearly indicated by framing of a number and a central highlighting thereof. Additionally, the varied configuration of the applicator surface will enable easy registration with a bingo number by merely aligning an edge of the bingo dobber with the space on the bingo card.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is of enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved square bingo dobber which has all the advantages of the prior art square bingo dobber and none of the disadvantages.

It is another object of the present invention to provide a new and improved square bingo dobber which may be easily and efficiently manufactured and marketed.

It is a further object of the present invention to provide a new and improved square bingo dobber which is of a durable and reliable construction.

An even further object of the present invention is to provide a new and improved square bingo dobber which is susceptible of a low cost of manufacture with regard to both materials and labor, and which accordingly is then susceptible of low prices of sale to the consuming public, thereby making such square bingo dobbers economically available to the buying public.

Still yet another object of the present invention is to provide a new and improved square bingo dobber which provides in the apparatuses and methods of the prior art some of the advantages thereof, while simultaneously overcoming some of the disadvantages normally associated therewith.

Still another object of the present invention is to provide a new and improved square bingo dobber formed with a central reservoir and a surrounding reservoir to convey fluid to a central applicator pad and a surrounding applicator pad.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 3:
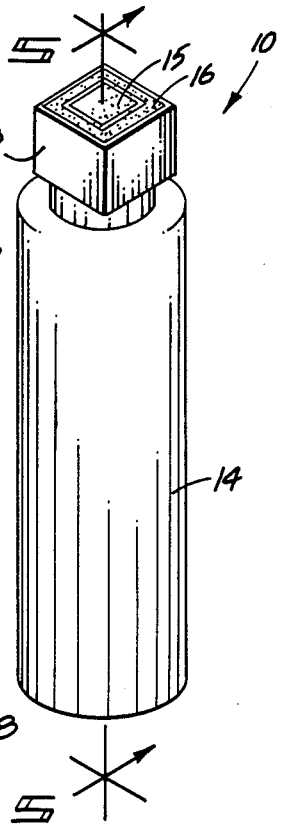
FIG. 3 is a side isometric view of the bingo dobber of the present invention.
Figure 4:
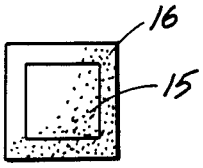
FIG. 4 is a top orthographic view of the bingo dobber of FIG. 3.

With reference now to the drawings, and in particular to FIG. 3 thereof, a new and improved square bingo dobber embodying the principles and concepts of the present invention and generally designated by the reference numeral 10 will be described.

Figure 1:
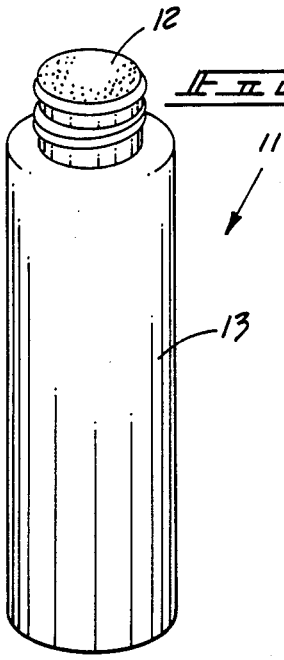
Fig 1 PRIOR ART
FIG. 1 is a side isometric view of a prior art bingo dobber.
Figure 2:
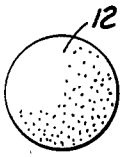
FIG. 2 is a top orthographic view of the prior art bingo dobber of FIG. 1.

FIG. 1 is illustrative of the prior art apparatus as conventionally utilized in the game of bingo whereby participants may indicated by application of suitable marking liquids a number so indicated. As is well known, in the game of bingo is played by the random selection of various numbers. When particular are numbers are selected, the participants will mark in the squares containing the number and generally use prior art devices as indicated generally by the number 11, such apparatus by means of its hemispherical outline and circular configuration does not completely mark the square by filling up the enclosed surface containing the number or else tends to intrude into or mark an adjacent number to the awkward shaping of the applicator 11 relative to the square spaced to be marked. Essentially therefore, the circular applicator configuration 12 houses in a typical container 13 has been awkward as utilized in the application in the game of bingo.

More specifically, attention will be drawn to FIG. 3 illustrative of my invention. A housing 14 has supported thereon a support head 18 containing therein a first applicator pad 15 formed of a central square element. A second applicator pad 16 is positioned in a surrounding perimeter square relationship to first applicator pad 15. Applicator pads 15 and 16 are formed of porous resiliant elements capable of transmitting liquid therethrough of construction and materials well known in the prior art. Applicator pads 15 and 16, furthermore as may be seen in FIG. 5, extend somewhat beyond terminal portions of a support head 18 and a central support head 19. This enables compression of pads 15 and 16 against an intended application surface to enhance transmission and imparting of a fluid through respective pads 15 and 16 to said surfaces.

Figure 5:
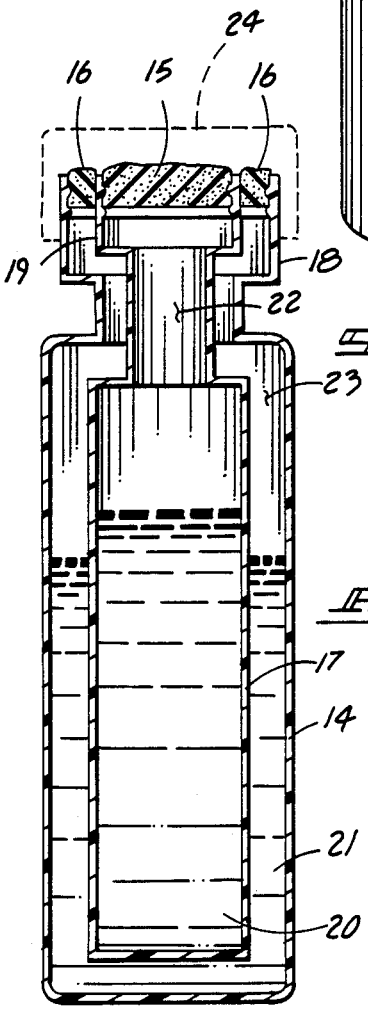
FIG. 5 is a side orthographic view taken along the lines 5—5 in the direction indicated by the arrows of FIG. 3.

With further attention to FIG. 5, it may be noted that an inner housing 17 supports a central reservoir 20 and defines between housing 14 and 17 an outer reservoir 21 in support of a further fluid whereby reservoirs 20 and 21 by means of channels 22 and 28 respectively provide a marking fluid supply to pads 15 and 16 respectively.

In use, a marking or indicating fluid contained within central reservoir 20 is of a transparent-like nature, such as yellow, to highlight and enable "at a glance" understanding of a bingo number so marked by use of my invention. Fluid within outer reservoir 21 is of a marking nature to be characterized as an opaque fluid, such as black or brown for example, to provide a framing of fluid contained within reservoir 20 applied to a surface to completely mark a bingo square by outlining a number contained therein and further emphasizing a number so framed.

Modifications of my device include a cap portion 24 illustrated in phantom designation and utilized in tight interfitting relationship to central head 18 to prevent fluids contained within pads 15 and 16 from drying and hardening upon prolonged exposure to ambient air. Cap 24 may be of a resilient press fit onto support head 18 or may be optionally threadedly secured thereto.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved square bingo dobber comprising, a container including an outlet; said outlet defining a central square porous applicator formed with a first fluid porous surface for imparting a first transparent indicating liquid onto a desired surface, and a second porous applicator formed with a second surrounding fluid porous surface of square configuration in surrounding relationship to said first central applicator surface for imparting an opaque second coloration onto a desired surface simultaneously with said central applicator, and said first outer surface and said second surrounding surface are fixedly secured to relative to each other and said container and positioned in essentially the same plane, and said central applicator and said second applicator are provided with indicating fluid from a first and a second reservoir formed in communication with said central applicator and said second applicator respectively, and wherein a central housing defines said first reservoir and a second housing defines said second reservoir wherein said second housing is formed in surrounding relationship to said first housing, and wherein said outlet includes a central porous applicator secured by a central support head and said second outer applicator being secured by an outer support head wherein said outer support head is in surrounding relationship to said central support head, and wherein said central support head is in fluid communication with said central reservoir and said outer support head is in fluid communication with said outer reservoir.

* * * * *